United States Patent [19]

Sato

[11] Patent Number: 5,011,313

[45] Date of Patent: Apr. 30, 1991

[54] PAPER FEED MECHANISM FOR A PRINTER

[75] Inventor: Hiroyuki Sato, Sumida, Japan

[73] Assignee: Seikosha Co., Ltd., Tokyo, Japan

[21] Appl. No.: 421,869

[22] Filed: Oct. 16, 1989

[30] Foreign Application Priority Data

Oct. 20, 1988 [JP] Japan ..... 63-265046

[51] Int. Cl.[5] ..... B41J 11/50

[52] U.S. Cl. ..... 400/605; 400/636; 400/636.3; 400/637

[58] Field of Search ..... 400/636, 636.1, 636.2, 400/636.3, 637, 637.2, 637.6, 638, 639, 639.1, 639.2, 641, 616, 616.1, 616.2, 617, 608.2, 605

[56] References Cited

U.S. PATENT DOCUMENTS

| | | | |
|---|---|---|---|
| 1,065,980 | 7/1013 | Steele | 400/638 |
| 1,549,873 | 8/1925 | Hokanson | 400/637.2 |
| 1,619,013 | 3/1927 | Armstrong | 400/637.2 |
| 4,498,795 | 2/1985 | Tatara | 400/636.1 |
| 4,564,305 | 1/1986 | Renewitz et al. | 400/605 |
| 4,579,471 | 4/1986 | Hendrischu | 400/605 |
| 4,663,722 | 5/1987 | sato | 400/605 |
| 4,688,958 | 8/1987 | Tajima | 400/636.3 |
| 4,830,527 | 5/1989 | Kikuchi et al. | 400/637.2 |
| 4,909,497 | 3/1990 | Itabashi | 400/605 |

FOREIGN PATENT DOCUMENTS

| | | | |
|---|---|---|---|
| 1138154 | 6/1967 | France | 400/637.2 |
| 0105373 | 6/1982 | Japan | 400/638 |
| 243323 | 10/1985 | Japan . | |
| 0116174 | 5/1987 | Japan | 400/605 |
| 0152876 | 7/1987 | Japan | 400/605 |
| 0193860 | 8/1987 | Japan | 400/636 |
| 0077769 | 4/1988 | Japan | 400/636.1 |

*Primary Examiner*—Eugene H. Eickhol

*Attorney, Agent, or Firm*—Jordan and Hamburg

[57] ABSTRACT

A paper feed mechanism includes a platen rotatably mounted on a frame and a friction feed having a support which rotatably supports a roller, the support being movable between an operable position in which the roller is in biasing engagement with the platen and a non-operable positon in which the roller is not biased toward said platen. A spring biasingly urges the support in its operable position in which the roller is in biasing engagement with the platen. A cam is rotatably mounted on the frame and rotatable between a first cam position which moves the support to its non-operable position and a second cam position which permits the support to be moved to its operable position by the spring, whereby the cam controls the operability of the friction feed.

17 Claims, 6 Drawing Sheets

PAPER FEED MECHANISM FOR A PRINTER

BACKGROUND OF THE INVENTION

The present invention relates to a paper feed mechanism for a printer provided with, for example, both a tractor feed mechanism and a friction feed mechanism as form feed means.

Conventionally, in a printer provided with both a tractor feed mechanism and a friction feed mechanism, there is provided a mechanism which switches the elastic contact force of a friction roller which elastically contacts a platen according to the paper feed mode. The arrangement is such that elastic contact is made strongly in the case of the friction feed, and elastic contact is made weakly in the case of the tractor feed. For example, in Japanese Patent application No. SHO60-243323 of the present applicant, a construction is disclosed in which the elastic contact force on the platen of the friction roller is changed over by using a cam having a complicated shape, a cam follower which follows this cam, a plurality of levers, and a spring.

In such a conventional mechanism for adjusting the frictional force between the recording paper and the platen according to the tractor feed and the friction feed, respectively, there have been such drawbacks in that the construction is complicated and a long time is required for assembly. In addition, it is difficult to set the frictional force between the recording paper and the platen in respective form feed modes.

It is an object of the present invention to make it easy to set the frictional force between the recording paper and the platen for the tractor feed and the friction feed, and further to improve the assembling characteristics by means of a simple construction.

SUMMARY OF THE INVENTION

In order to achieve the above-mentioned object, a paper feed mechanism according to the present invention comprises a paper guide movable in a direction opposing an outer circumferential surface of a platen, a movable member supported movably below the paper guide, friction rollers which are provided movably on the movable member and are capable of contacting the outer circumferential surface of the platen elastically, a first spring urging the friction roller toward the platen through the movable member, rotatably cam means which engages the movable member when located at a first rotational position so as to move the movable member against the urging force of the first spring and release the engagement with the movable member when located at a second rotational position, and a second spring which has a spring force weaker than that of the first spring and is mounted between the movable member and the paper guide so as to urge the paper guide toward the platen.

Also, when a pair of friction rollers are utilized to contact the platen elastically, a rockable roller holder is provided on the movable member, and a pair of friction rollers are provided on either side of the rocking center of the roller holder. The second spring is mounted between the roller holder and the paper guide.

BRIEF DESCRIPTION OF THE DRAWINGS

FIGS. 1-4 show one embodiment according to the present invention wherein:

FIG. 1 is a front view showing the operating condition of the tractor feed;

FIG. 2 is a front view showing the operating condition of the friction feed;

FIG. 3 is a front view of the drive wheel train; and

FIG. 4 is a plan view of FIG. 3.

FIGS. 5 and 6 show another embodiment according to the present invention wherein:

FIG. 5 is a front view showing the operating condition of the tractor feed; and

FIG. 6 is a front view showing the operating condition of the friction feed.

DESCRIPTION OF THE PREFERRED EMBODIMENTS

Embodiments of the present invention will now be described with reference to the drawings.

Figure 1:
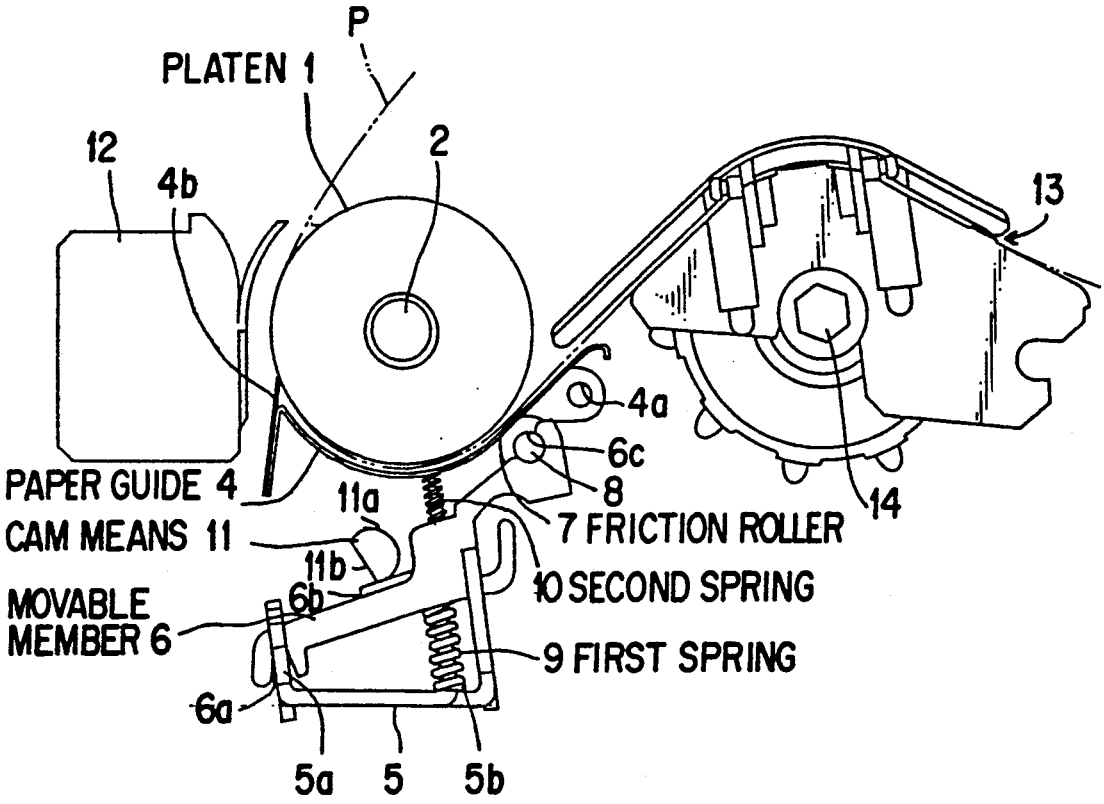
Figure 2:
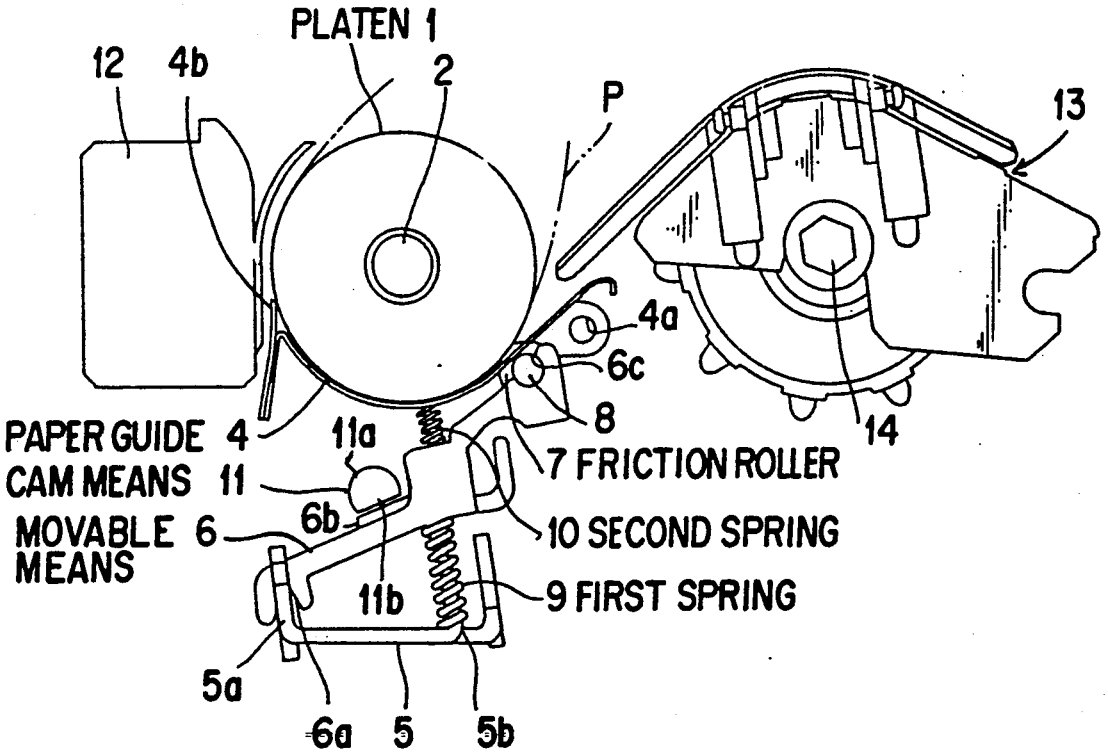

As shown in FIG. 1 and FIG. 2, a platen 1 is fixedly secured on a shaft 2, and both end portions of the shaft 2 are supported rotatably on side plates 3 (shown in FIG. 3), which are opposed to each other at a predetermined spacing. At the lower part of the platen 1, a movably mounted paper guide 4 is disposed opposite to the outer circumferential surface of the platen 1. The paper guide 4 is provided with a hole 4*a* at one end portion thereof and is supported rockably on the side walls 3 through a shaft not shown. At another end portion of the paper guide 4, a paper retaining plate 4*b* which can contact the outer circumferential surface of the platen 1 is provided.

At the under part of the paper guide 4 a member 6 is movably supported. That is, a baseplate 5 extends parallel to the platen 1, and both end portions of the baseplate 5 are fixedly secured to the side plates 3. One side edge of the baseplate 5 is bent upward and is provided with a receiver 5*a* at predetermined position thereof. At one end portion of the movable member 6, an engaging portion 6*a* consisting of a U-shaped groove is formed, and the engaging portion 6*a* engages with the receiver 5*a* such that the movable member 6 is thereby supported rockably on the baseplate 5.

A contact portion 6*b* is provided on the upper surface of the movable member 6. The movable member 6 also has a bearing groove 6*c* which rotatably receives a shaft 8 which is provided with a friction roller 7 formed at another end portion thereof. A first spring 9 is fitted to a projection 5*b* which extends upward from the baseplate 5. The first spring 9 urges the friction roller 7 toward the platen 1 through the movable member 6. The friction roller 7 can contact the platen 1 elastically upon passing through an opening (not shown) provided on the paper guide 4.

A second spring 10 is mounted between the movable member 6 and the paper guide 4. The second spring 10 is set so as to have a spring force weaker than that of the first spring 9 and urges the paper guide 4 toward the platen 1.

A cam means 11 is disposed above the contact portion 6*b*. The cam means 11 is provided with a first cam surface 11*a* having a circular arc surface which engages with the contact portion 6*b* of the movable member 6 to thereby push down the movable member 6 against the urging force of the first spring 9 and a second cam surface 11*b* having a plane surface which releases the engagement with the movable member 6, thereby allowing the movable member 6 to be pushed up by the urging force of the first spring 9. Thus it will be seen that when the cam means 11 is located at a first rotational position, the first cam surface 11*a* engages the contact portion 6*b*, and when the cam means 11 is located at a second rotational position, the second cam surface 11*b* is separated with a fixed space from the contact portion 6*b*. The cam means 11 has a rod shape and is supported rotatably by the side plates 3 at both ends thereof.

A printing head 12 is disposed on a carriage (not shown) opposing the platen 1, and a tractor mechanism 13 is disposed on the opposite side of the platen. The tractor mechanism 13 is fitted in a relatively non-rotatable manner and is movable in an axial direction with respect to a shaft 14 which is supported rotatably on the side plates 3 at both end portions thereof. P denotes a recording paper.

Figure 3:
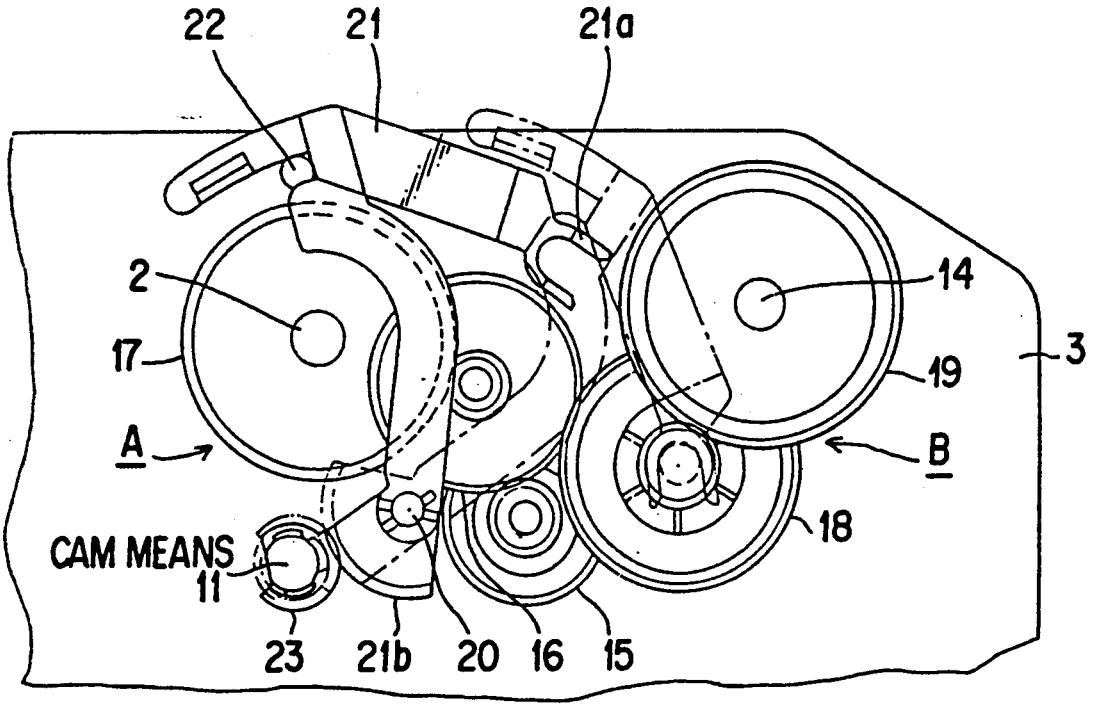

FIG. 3 shows the platen shaft 2, the shaft 14 along with the rotational drive mechanism of the tractor mechanism 13, and the rotational mechanism of the cam means 11. That is, the end portions of the shaft 2 of the platen 1, the shaft 14 of the tractor mechanism 13 and the cam means 11 are projected outwardly of the side plate 3.

First, a wheel train which drives the shafts 2 and 14 will be described A gear 17 which is fixedly secured to the shaft 2 and a gear 16 mesh successively with a drive gear 15 which receives a rotational driving force from a drive motor (not shown), thus forming a first gear wheel train A for rotatably driving the platen 1.

In order to rotatably drive the tractor mechanism 13, a gear 19 which is fixedly secured to the shaft 14 and a gear 18 mesh successively with the gear 16, thus forming a second wheel train B.

In the case of the tractor feed, the gear 16 and the gear 18 mesh with each other, and the rotational driving force is transmitted both to the first wheel train A and the second wheel train B, so that the platen 1 and the tractor mechanism 13 are driven to rotate at the same time. The rotating speed of the platen 1 is set to be somewhat faster than the rotating speed of the tractor mechanism 13.

In the case of the friction feed, it is arranged so that only the platen 1 is driven to rotate by interrupting the transmission of the torque to the second wheel train B such that the tractor mechanism 13 does not rotate. Interruption of transmission of the torque to the second wheel train B is effected by a conical cam 18*a* (FIG. 4) which is provided integrally and concentrically with respect to the gear 18 and an operation lever 21 provided rockably on a shaft 20 provided on the side plate 3. The gear 18 is rotatably provided on a shaft 29 (FIG. 4) secured to the side plate 3. A retainer ring 31 is provided on the end of the shaft 29, and a spring 30 is wound around the shaft 29 between the retainer ring 31 and the gear 18.

At the end portion of the operation lever 21, an engaging portion 21*a* having a U-shape and a side surface thereof forming a tapered surface 21*c* is formed. The engaging portion 21*a* of the operation lever 21 enters from the side of the conical cam 18*a* by means of the rocking of the lever 21 as shown with chain lines in FIG. 3 such that the gear 18 is moved axially, thereby to separate the mesh between gear 18 and gear 16. A protrusion 22 which regulates the retreat position of the operation lever 21 is provided on the side plate 3. When the operation lever 21 is positioned at the retreat position as shown by solid lines in FIG. 3, the conical cam 18*a* is biased leftwardly in FIG. 4 by the force of the spring 30.

In the case of friction feed, the operation lever 21 is moved to the position shown by the broken lines in FIG. 3, and the engaging portion 21*a* of the operation lever 21 enters from the side of the conical cam 18*a*. Accordingly, the conical cam 18*a* is moved rightwardly in FIG. 4 against the bias of spring 30, and the gear 18 is disengaged from the gear 16.

In order to rotate the cam means 11 interlocking with the rocking of the operation lever 21 when the friction feed and the tractor feed are changed over from each other, a sector gear 21*b* is formed concentrically with the shaft 20, which becomes the rocking center at the central part of the operation lever 21. A pinion 23 is fixedly secured to the cam means 11, and the sector gear 21*b* and the pinion 23 mesh with each other. As a result, the cam means 11 is rotated interlocking with the rocking of the operation lever 21.

With such a construction, in the case of tractor feed with the operation lever 21 at the retreat position as shown in solid lines in FIG. 3, the engaging portion 21*c* of the operation lever 21 does not engage with the conical cam 18*a*, and the gear 16 and the gear 18 are in a meshed state. Accordingly, the torque from the drive gear 15 is transmitted to the first wheel train A and the second wheel train B, and rotates the shafts 2 and 14 so as to rotatingly drive the platen 1 and the tractor mechanism 13, thus effecting paper feed by the tractor mechanism 13. In such a state, the cam means 11 is located at the first rotational position as shown in FIG. 1, and the first cam surface 11*a* contacts the contact portion 6*b* and pushes down the movable member 6 against the urging force of the first spring 9. As a result, the friction roller 7 does not contact the platen 1 elastically, and the strong spring force of the first spring 9 is not exerted on the platen 1. Even in such a state, however, the recording paper P is pressed against the platen 1 through the paper guide 4 by the weak spring force of the second spring 10 so that an appropriate frictional force is applied between the recording paper P and the platen 1. Also, since the platen 1 is set so as to rotate somewhat faster than the tractor mechanism 13, the recording paper P is applied with an appropriate tension when the recording paper P is fed by the rotation of the tractor mechanism 13.

Next, in the case of friction feed, the operation lever 21 is driven rockably clockwise to the position shown by chain lines in FIG. 3 such that the engaging portion 21*c* enters from the side of the conical cam 18*a* and axially moves the gear 18. Thus, the gear 18 is no longer in mesh with the gear 16, and the torque from the drive gear 15 is transmitted to the first wheel train A, but is not transmitted to the second wheel train B. Accordingly, the platen 1 is driven to rotate by the rotation of the shaft 2, but the tractor mechanism 13 is not driven to rotate because the shaft 14 does not rotate.

By means of the rocking of the operation lever 21, the pinion 23 is rotated counterclockwise through the sector gear 21*b* such that the cam means 11 is positioned at the second rotational position as shown in FIG. 2, and the second cam surface 11*b* thereof faces the contact portion 6*b* at a predetermined space. As a result the movable member 6 has applied thereto the strong spring force or the first spring 9 and presses the recording paper strongly to the platen 1 elastically by means of the friction roller 7. Furthermore, since the movable member 6 is located at the upward position the second spring 10 also presses the recording paper against the platen 1 elastically through the paper guide 4 to provide a stronger urging force than the case mentioned above.

Figure 4:
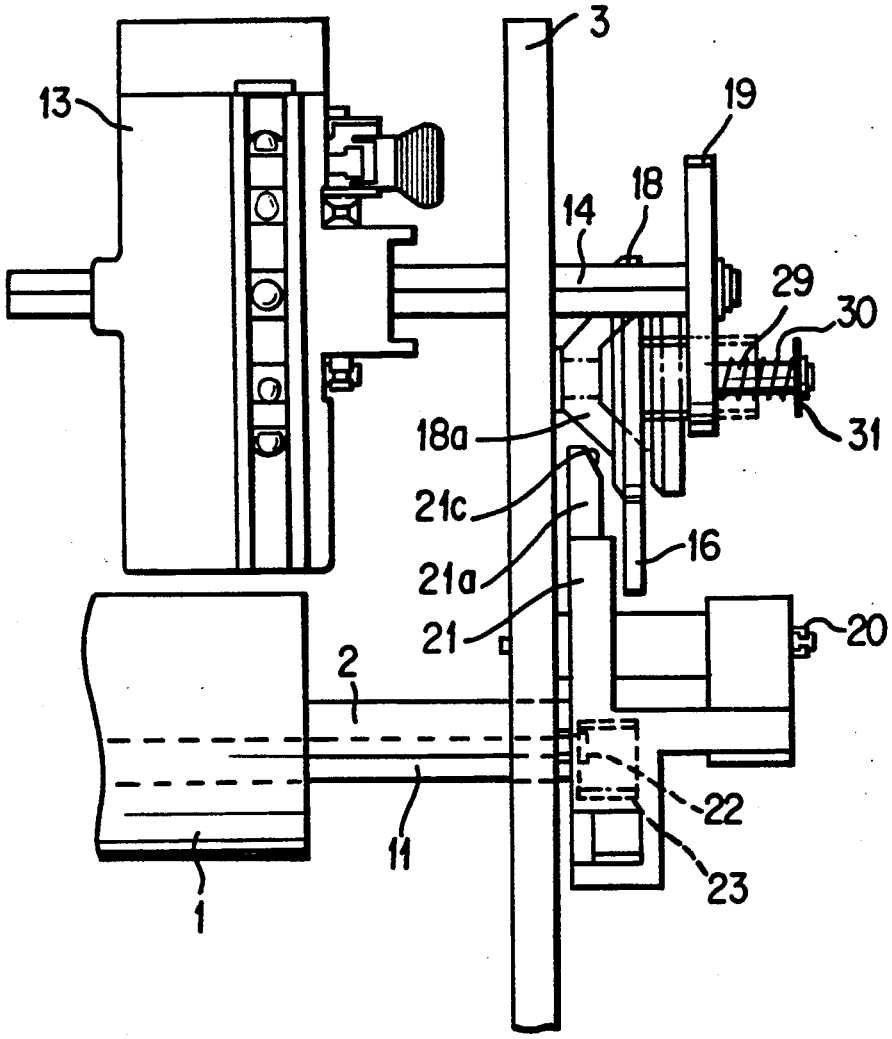
Figure 5:
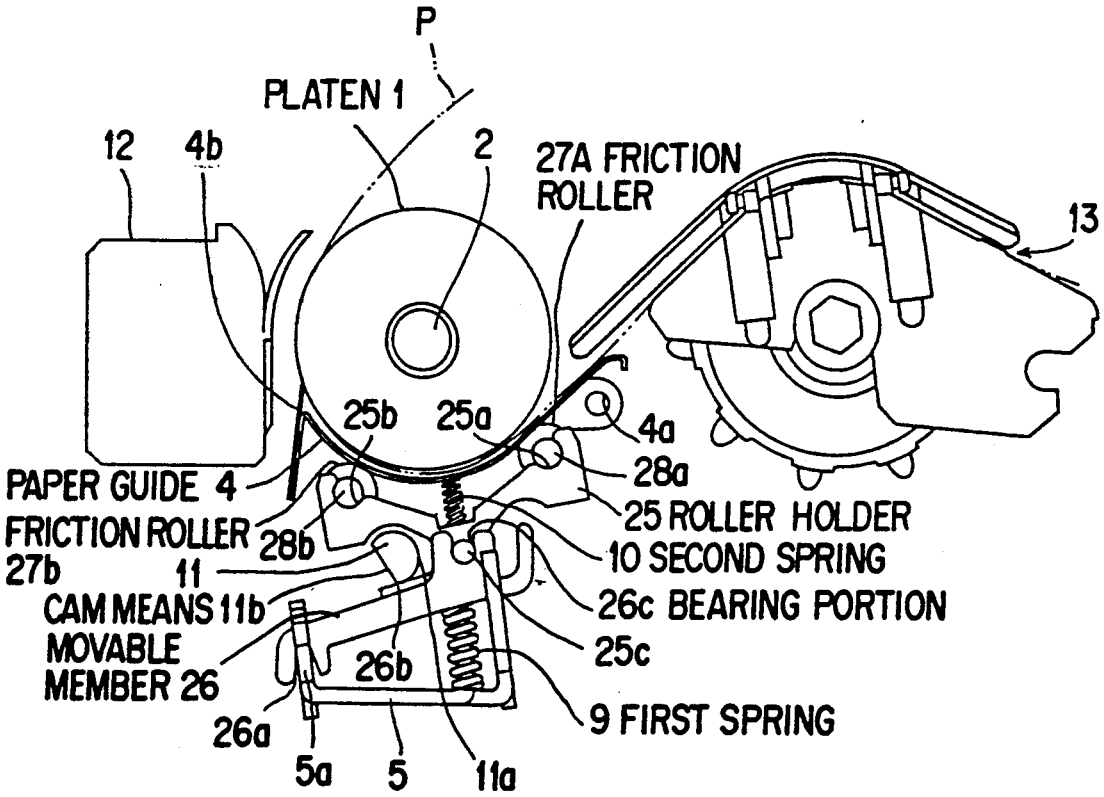
Figure 6:
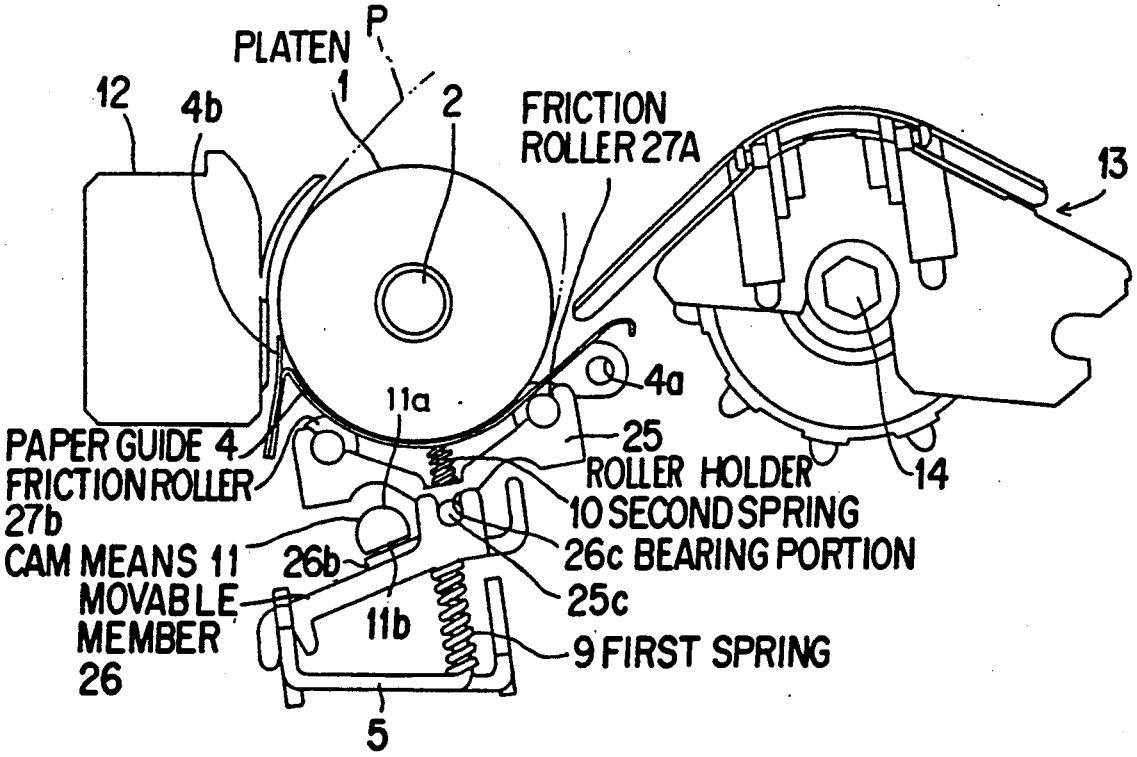

In another embodiment, shown in FIGS. 4 and 5, a pair of friction rollers are used. In this second embodiment, the same numerals are assigned to those parts that have the same construction.

In the embodiment of FIGS. 4 and 5, a movable member 26 located under the paper guide 4 has an engaging portion 26*a* consisting of a U-shaped groove formed at one end portion thereof, and the movable member 26 is supported rockably by a baseplate 5 by the fact that the engaging portion 26*a* engages with the receiver 5*a*. A contact portion 26*b* is provided on the upper surface of the movable member 26, and a bearing portion 26*c* is provided at another end of the movable member 26. The first spring 9 contacts the lower surface of the movable member 26 elastically, and exerts its urging force in a direction tending to raise the bearing portion 26*c*.

A center shaft 25*c* of a roller holder 25 is fitted rotatably in the bearing portion 26*c* to thereby receive the roller holder 25 rockably. On both sides of the center of rotation of the roller holder 25, bearing grooves 25*a* and 25*b* receive rotatably shafts 28*a* and 28*b* provided with friction rollers 27*a* and 27*b*. The previously mentioned second spring 10 is mounted between the roller holder 25 and the paper guide 4. The cam means 11 is positioned above the contact portion 26*b* and has the same construction as that previously described.

With such a construction, when the tractor feed is selected, the cam means 11 is located at the first rotational position as shown in FIG. 4, the movable member 26 has moved downwardly against the urging force of the first spring 9, and the roller holder 25 also moves downwardly. As a result, the friction rollers 27*a* and 27*b* do not contact the platen 1 elastically, and the strong urging force of the first spring 9 is not exerted on the platen 1. However, the weak urging force of the second spring presses the recording paper against the platen 1 through the paper guide 4 in a manner as previously described in the first embodiment.

Next, when the friction feed is selected, the cam means 11 is disposed at the second rotational position and releases the engagement with the movable member 26 as shown in FIG. 5. Therefore, the movable member 26 receives the strong urging force of the first spring 9, pushes up the roller holder 25 and elastically presses the recording paper strongly against the platen 1 by means of the friction rollers 27*a* and 27*b*. Since the roller holder 25 is rockably mounted, the friction rollers 27*a* and 27*b* contact the platen elastically with a uniform force. Also, with the roller holder 25 being at an upward position, the second spring 10 pushes the recording paper against the platen 1 elastically through the paper guide 4 with a stronger urging force than that just described.

Although the movable members 6 and 26 are described as being rockable, they are not necessarily limited to such an arrangement but may be arranged so as to be movable vertically.

As described above, in a paper feed mechanism according to the present invention, the pressing force of the paper guide against the platen is changed in accordance with the changeover of the tractor feed to and from the friction feed. Therefore, it is possible to set the frictional force between the recording paper and the platen at an appropriate value in accordance with respective modes of form feed. Also, it is only required to mount the movable member, the roller holder, the friction roller and so forth consecutively in assembly, so assembly may be performed very easily. Furthermore, since there are only a few parts having simple shapes such as the movable member and the roller holder, etc., the construction is simple and the cost may be reduced.

Although the present invention has been described through specific terms, it should be noted here that the described embodiment is not necessarily exclusive and that various changes and modifications may be imparted thereto without departing from the scope of the invention which is limited solely by the appended claims.

What I claim is:

1. A paper feed mechanism for feeding paper comprising:

a frame means;

a platen rotatably mounted on said frame means;

a friction feed means mounted on said frame means and having roller means movable between an operable position in which said roller means is in biasing engagement with said platen and a non-operable position in which said roller means is not biasingly urged toward said platen;

a tractor feed means juxtaposed to said platen;

drive means for driving said platen and said tractor feed means;

actuating means having a first actuated position in which said drive means is operable to drive both said platen and said tractor feed means and a second actuated position in which said drive means is operable to drive said platen and does not drive said tractor feed means;

interconnecting means operably interconnected between said actuating means and said friction feed means such that when said actuating means is in said first actuated position, said friction feed means is disabled and said tractor feed means feeds said paper, and when said actuating means is in said second actuated position, said tractor feed means is disabled and said friction feed means feeds said paper;

said friction feed means comprising support means pivotably supporting roller means, said support means being movable between said operable and non-operable positions, cam means rotatable between a first cam position to effect positioning of said support means in said operable position and a second cam position to effect positioning of said support means in said non-operable position, said interconnecting means being operably connected between said cam means and said lever such that pivotal movement of said lever rotates said cam means.

2. A paper feed mechanism comprising:

a frame means;

a platen rotatably mounted on said frame means;

friction feed means comprising support means mounted on said frame means and rotatably supporting roller means, said support means being movable between an operable position in which said roller means is in biasing engagement with said platen and a non-operable position in which said roller means is not biased toward said platen;

spring means biasingly urging said support means in said operable position in which said roller means is in biasing engagement with said platen;

a cam means rotatably mounted on said frame means and rotatable between a first cam position which moves said support means to said non-operable position and a second cam position which permits said support means to be moved to said operable position by said spring means, whereby said cam means controls the operability of said friction feed means;

a paper guide mounted on said frame means and movable toward and away from said platen, said paper guide being disposed between said platen and said support means, and biasing means between said paper guide and said support means biasingly urging said paper guide toward said platen, said spring means having a greater biasing force than said biasing means.

3. A paper feed mechanism according to claim 2, wherein said biasing means biases said paper guide toward said platen when said support means is in either its operable or its non-operable position.

4. A paper feed mechanism according to claim 2, wherein said paper guide comprises a guide plate having an opening, said roller means extending through said opening to biasingly engage said platen when said support means is in said operable position.

5. A paper feed mechanism according to claim 2, wherein said support means comprises a support member and pivot means pivotably supporting said support member on said frame means for pivotable movement between said operable and non-operable positions, said spring means being disposed between said support member and said frame means to bias said support member toward said platen to said operable position.

6. A paper feed mechanism according to claim 2, wherein said support means comprises a support member and pivot means pivotably supporting said support member on said frame means, a roller holder pivotably mounted on said support member, said roller means being rotatably mounted on said roller holder.

7. A paper feed mechanism according to claim 6, wherein said roller means comprises at least two rollers, said roller holder rotatably mounting said at least two rollers at circumferentially spaced locations about the outer circumference of said platen.

8. A paper feed mechanism according to claim 7, wherein said support member has pivot means for pivotably mounting said roller holder, said pivot means being disposed between said at least two rollers.

9. A paper feed mechanism for feeding paper comprising:

a frame means;

a platen rotatably mounted on said frame means;

a friction feed means mounted on said frame means and having roller means movable between an operable position in which said roller means is in biasing engagement with said platen and a non-operable position in which said roller means is not biasingly urged toward said platen;

a tractor feed means juxtaposed to said platen;

drive means for driving said platen and said tractor feed means;

actuating means having a first actuated position in which said drive means is operable to drive both said platen and said tractor feed means and a second actuated position in which said drive means is operable to drive said platen and does not drive said tractor feed means.

interconnecting means operably interconnected between said actuating means and said friction feed means such that when said actuating means is in said first actuated position, said friction feed means is disabled and said tractor feed means feeds said paper, and when said actuating means is in said second actuated position, said tractor feed means is disabled and said friction feed means feeds said paper;

said actuating means comprising a pivotably mounted lever, an axially shiftable cam means, and a biasing means biasing said cam means in one axial direction, said lever being pivoted to said second actuated position to engage and to axially shift said cam means to a disengaged position, said lever being pivoted to said first actuated position to permit said biasing means to shift said cam means axially to an engaged position, a first gear means carried by said cam means, and a second gear means for driving said tractor feed means, said first gear means meshing with said second gear means when said cam means is in said engaged position, said first gear means being out of mesh with said second gear means when said cam means is in said disengaged position, whereby the axial position of said axially shiftable cam means determines the operability of said tractor feed means.

10. A paper feed mechanism according to claim 9, wherein said cam means has a conical surface having a conical axis, said cam means being axially shiftable along said conical axis.

11. A paper feed mechanism according to claim 10, wherein said lever has an engaging portion operable to engage said conical surface to shift said cam means axially along said conical axis.

12. A paper feed mechanism according to claim 11, wherein said engaging portion has a generally U-shaped configuration.

13. A paper feed mechanism according to claim 11, wherein said lever is pivotable in a plane perpendicular to the pivotable axis of said lever, said engageable surface being inclined at an acute angle relative to said plane.

14. A paper feed mechanism for feeding paper comprising:

a frame means;

a platen rotatably mounted on said frame means;

a friction feed means mounted on said frame means and having roller means movable between an operable position in which said roller means is in biasing engagement with said platen and a non-operable position in which said roller means is not biasingly urged toward said platen;

a tractor feed means juxtaposed to said platen;

drive means for driving said platen and said tractor feed means;

actuating means having a first actuated position in which said drive means is operable to drive both said platen and said tractor feed means and a second actuated position in which said drive means is operable to drive said platen and does not drive said tractor feed means;

interconnecting means operably interconnected between said actuating means and said friction feed means such that when said actuating means is in said first actuated position, said friction feed means is disabled and said tractor feed means feeds said paper, and when said actuating means is in said second actuated position, said tractor feed means is disabled and said friction feed means feeds said paper;

said drive means comprising first and second gears, said actuating means comprising a pivotably mounted lever pivotal to said first actuated position to effect engagement of said first and second gears and pivotal to said second actuated position to effect disengagement of said first and second gears;

said friction feed means comprising support means pivotably supporting roller means, said support means being movable between said operable and non-operable positions, cam means rotatable between a first cam position to effect positioning of said support means in said operable position and a second cam position to effect positioning of said support means in said non-operable position, said interconnecting means being operably connected between said cam means and said lever such that pivotal movement of said lever rotates said cam means.

15. A paper feed mechanism according to claim 14, wherein said cam means comprises a rotatable shaft, said interconnecting means comprising a first gear means on said shaft, said interconnecting means further comprising a second gear means rotatable with said lever, said first gear means meshing with said second gear means.

16. A paper feed mechanism according to claim 14, further comprising spring means between said frame means and said support means biasingly urging said support means into said operable position.

17. A paper feed mechanism according to claim 16, wherein said cam means is spaced from said support means when said support means is in said operable position.

* * * * *